US005549048A

United States Patent [19]

Godfrey-Phillips et al.

[11] Patent Number: 5,549,048

[45] Date of Patent: Aug. 27, 1996

[54] BIODEGRADABLE SHOT-GUN CARTRIDGE CASE

[75] Inventors: Arthur H. Godfrey-Phillips, Kent, United Kingdom; Graham Chapman, Tonawanda, N.Y.

[73] Assignee: The Kent Cartridge Manufacturing Company Limited, Tonbridge, United Kingdom

[21] Appl. No.: 137,026

[22] PCT Filed: Apr. 22, 1992

[86] PCT No.: PCT/GB92/00737

§ 371 Date: Oct. 18, 1993

§ 102(e) Date: Oct. 18, 1993

[87] PCT Pub. No.: WO92/18826

PCT Pub. Date: Oct. 29, 1992

[30] Foreign Application Priority Data

Apr. 22, 1991 [GB] United Kingdom ..... 9108555

[51] Int. Cl.[6] ..... F42B 5/30; F42B 7/06

[52] U.S. Cl. ..... 102/466; 102/467; 523/126; 523/128

[58] Field of Search ..... 102/466, 467; 523/126, 128

[56] References Cited

U.S. PATENT DOCUMENTS

| | | | |
|---|---|---|---|
| 3,103,170 | 9/1963 | Covington, Jr. et al. | 102/466 |
| 3,147,709 | 9/1964 | Werner | 102/466 |
| 3,722,412 | 3/1973 | Herter | 102/466 |
| 4,017,469 | 4/1977 | Nicoud espouse Le Brasseur | 523/126 X |
| 4,931,488 | 6/1990 | Chiquet | 523/126 |

FOREIGN PATENT DOCUMENTS

| | | |
|---|---|---|
| 0181473 | 5/1986 | European Pat. Off. . |
| 2136704 | 1/1972 | Germany . |
| 1401418 | 7/1975 | United Kingdom . |
| WO86/05871 | 10/1986 | WIPO . |

*Primary Examiner*—Richard D. Lovering
*Attorney, Agent, or Firm*—Nixon & Vanderhye P.C.

[57] ABSTRACT

A shot-gun cartridge case is disclosed which is made by extrusion or equivalent pressure forming of high density polyolefin-based composition containing biodegradable starch, a fatty acid ester to initiate peroxide attack on the double bonds of the polyolefin and an anti-oxidant stabilizing compound. The composition is stable to biological and chemical degradation until the cartridge is fixed, upon which fixing, the anti-oxidant stabilizing compound is partially destroyed or dispersed so that degradation of said composition takes place.

3 Claims, No Drawings

BIODEGRADABLE SHOT-GUN CARTRIDGE CASE

DESCRIPTION

This invention relates to cartridge cases for shotguns.

The traditional shotgun cartridge comprised a cartridge case made out of a paper tube with a paper base wad and a brass or steel head together with explosive powder, a fiber wad and lead shot. The end of the paper tube was closed by either forming a fluted crimp or inserting a cardboard disc which was held in place by a rolled turnover.

The components described above were all degradable because they were either made from cardboard or paper or were made of organic materials and steel which corrodes.

The invention of plastics and the accompanying technology enabling accurate extrusion of plastic tube revolutionised the shotgun cartridge component industry. The paper tube was replaced by a plastic tube made from extruded thermoplastic synthetic resin polyethylene, the base wad was made from injection moulded polyethylene and the piston wad was made from injection moulded polyethylene. The result of these new materials was a cheaper shotgun cartridge which was more consistent in ballistic performance than the original paper based product. The drawings of our WO 91/05982 illustrate this more modem cartridge.

The synthetic resin (plastics) materials have however led to an environmental problem because the plastic cartridge casing (1 in the drawings mentioned above) after firing, is ejected from the gun and is left lying on the ground where it will remain for an almost indefinite period. The plastics piston wad is also projected from the gun upon firing and falls to the ground once again remaining for an indefinite period. WO 91/05982 deals with this problem and provides an improved and biodegradable wad.

Discarded plastics products are an environmental pollutant insofar as they are being introduced into the environment at a greater rate than they are removed by natural forces. The present invention uses additives for the plastics which convert the normal polyethylene tube constituting the cartridge case and extruded on standard production machines into an article which after firing will degrade by the action of bacteria and fungi and optionally also by the action of light. The cartridge case in accordance with the present invention should biodegrade and be removed from the environment at a greater rate than it is being introduced by the use of shotguns. The new case therefore is a considerable advance over the previous non-biodegradable cases from the point of view of environmental pollution.

Earlier patent specifications have proposed various additives which have modified plastics to render them photodegradable. Other additives have been proposed which create biodegradable plastic materials for general use. However, there has been no product until this present invention which has brought together the properties of biodegradation and photo-degradation to extruded plastics which have relatively thick cross-sections such as the components used for shotgun cartridges. By thick we mean of the order of 2 to 3 mm as opposed to films whose thicknesses may be measured in microns. The previously proposed materials have tended to be unsuitable for shotgun cartridge cases because degradation has taken place spontaneously and gradually from the moment the plastic is manufactured, whereas the case according to the present invention remains stable until the shotgun cartridge is fired. The firing of the shotgun cartridge initiates the degradation process thereby making the product safe to use and predictable.

According to the present invention there is provided a shot-gun cartridge case made by extrusion or equivalent pressure forming process of a synthetic-resin based composition said composition containing bio and or other degradants but being stable in the thick-wall form until the cartridge is fired.

Thus the present invention provides a shotgun cartridge case formed from a plastics rendered potentially degradable by one or more additives, the plastic being stable until the gun is fired but thereafter becoming environmentally degradable. The degradation is principally biodegradation usually chemically enhanced but photodegradation may also be provided.

The additive will advantageously be starch-based and may be as described in U.K. Patent Specifications Nos. 1,485,833, 1,487,050, International Application WO 88/06609, (European Application No. 88 901 405.6 and U.S. Pat. No. 4,931,488) or International Application No. WO 88/09354.

The additive may include a stabilising compound which is wholly or partially destroyed and/or dispersed on the thermal and physical shock of firing. The degradation then takes place in the environment in which the cartridge case finds itself.

The invention will now be more specifically described in the following Example:

Cartridge cases are normally made from High Density (around 0.95) Polyethylene (HDPE) in a process that involves biaxially stretching pipe either by the mandrel expansion method or the internal pressure expansion process. These procedures are known to the skilled man. To produce a degradable cartridge case a masterbatch has been developed which could be used on the existing processes and could be added to the normal high density polymer at a level of between 5% and 20%. This masterbatch consists of a surface-modified starch as described in British Patent No. 1,487,050, an unsaturated ester and additional materials as described in U.S. Pat. No. 4,931,488 The carrier polymer for the masterbatch is selected from the available HDPE resins so that the "flow" of the pipe just below its crystalline melting point is sufficient to achieve the circumferential and longitudinal orientation. Typically a melt flow index of 1.3 is suitable but up to 7.0 can be used.

As explained in U.K. 1,485,833 and U.S. Pat. No. 4,931,488 degradation of a modified plastic when discarded in the environment will proceed by two interactive mechanisms one chemical by peroxide attack on the stable double bonds of the polyethylene or other polyolefin and the other biodegradation of the starch molecules. These two mechanisms interact and enhance one another by synergy. It is however necessary to have a cartridge case that is stable in processing and storage. In order to achieve this the HDPE used in its manufacture in accordance with a preferred feature of the invention contains stabilisers in the form of antioxidants. These antioxidants may be partially destroyed and/or dispersed during firing and this, coupled to the greater surface area exposed, allows the degradation to be accelerated when the cartridge is fired and discarded. The antioxidant will be present in a small quantity sufficient to stabilise the cartridge cases. Antioxidants of the hindered phenol type such as benzenepropanoic acid, 3,5-bis (1,1-dimethylethyl)-4-hydroxy-,2,2-bis [3-[3,5-bis (1,1-dimethyl)-4-hydroxyphenyl] -1-oxopropoxy] methyl]-1,3-propanediyl ester or octadecyl 3,5-bis(1,1-dimethyl ethyl)-4-hydroxybenzene propanoate, have been found suitable.

The starch present in the cartridge case as granules provides a nutrient source for microorganisms, such as fungi and bacteria, weakening the polymer matrix as well as greatly increasing the surface area of the plastic. The chemical degradation is a result of the oxidation of the polymer, which is accelerated by the particular ingredients present in the masterbatch. This second mechanism is enhanced by the increase in surface area provided by the removal of starch.

A typical masterbatch formulation is:

| | % by weight |
|---|---|
| ECOSTAR starch (i.e. surface modified starch according to U.K. Patent No. 1,487,050) | 43.00 |
| Soya bean oil | 6.00 |
| Calcium oxide | 6.00 |
| Ferric (12-hydroxy stearate)$_3$ | 1.40 |
| Cupric stearate | 0.25 |
| Benzophenone | 0.60 |
| High density polyethylene (BASF 5041 H) | 43.15 |
| containing sufficient, typically 4% by weight, antioxidant for the reasons set out above. | 100.00 |

The functions of the various ingredients are as set out above i.e.:

Starch—to provide a directly biodegradable component so that the cartridge matrix is opened up in an active biological environment; it also has an affect on the oxidative breakdown of the polymer.

Soya bean oil—a lubricant and a source of unsaturation in the polymer degradation process (U.K. Patent No. 1,485,833).

Calcium oxide—desiccant present to ensure there is no moisture in the masterbatch, which is essential for processing.

Ferric (12-hydroxy stearate)$_3$, Cupric stearate and Benzophenone—a synergistic combination of catalysts which accelerates the polymer breakdown (U.S. Pat. No. 4,931,488)

The effect of chemical oxidative degradation can be observed through oven aging tests followed by physical and chemical testing. In order to carry out these tests a fired cartridge case made as set out above is remoulded into a typical test piece, suitable for tensile measurements. These are then placed in an oven at 80° C. and the percentage elongation was measured up twenty seven days. The results comparing a standard HDPE cartridge case and one containing 15% of the masterbatch are shown below:

Elongation at break of HDPE samples stored at 80° C.

| Time in Days | % Elongation Control with no additive | With 15% additive |
|---|---|---|
| 0 | 838.7 | 849.1 |
| 4 | 846.9 | 631.6 |
| 7 | 842.1 | 90.7 |
| 27 | 832.6 | 9.8 |

Another advantage of the invention is that the spent cartridge case, as explained in the U.S. Pat. No. 4,931,498 is also photodegradable, so that, even when discarded in very dry conditions where little microbiological action can be expected, degradation will occur.

We claim:

1. A shot-gun cartridge case made by extrusion or equivalent pressure forming of high density polyolefin-based composition, said composition containing a biodegradable starch, a fatty acid ester to initiate peroxide attack on double bonds of the polyolefin and an anti-oxidant stabilizing compound, said composition being stable to biological and chemical degradation until the cartridge is fired, during firing said anti-oxidant stabilizing compound being partially destroyed or dispersed so that degradation of said composition takes place.

2. A cartridge case according to claim 1 wherein the antioxidant is a hindered phenol.

3. A shot-gun cartridge case made by extrusion or equivalent pressure forming of high density polyolefin-based composition, said composition containing between 5% and 20% of a masterbatch comprising a fatty acid ester to initiate peroxide attack on double bonds of the polyolefin, an anti-oxidant stabilizing compound and 43% by weight of a biodegradable starch, said composition being stable to biological and chemical degradation until the cartridge is fired, during firing said antioxidant stabilizing compound being partially destroyed or dispersed so that degradation of said composition takes place.

* * * * *